United States Patent [19]

Rene

[11] 4,191,333

[45] Mar. 4, 1980

[54] FLAME TIP FOR SOLDERING TORCH

[76] Inventor: Ralph Rene, 455 Paulison Ave., Passaic, N.J. 07055

[21] Appl. No.: 933,516

[22] Filed: Aug. 14, 1978

[51] Int. Cl.[2] ..... F23D 13/36

[52] U.S. Cl. ..... 239/543; 239/567

[58] Field of Search ..... 239/543, 548, 566, 567; 228/902; 431/344; 126/229, 231, 232, 234, 249, 271.1, 271.2 R; 266/56, 66, 904

[56] References Cited

U.S. PATENT DOCUMENTS 316,785 4/1885 Hoeveler et al. ..... 239/543 X

FOREIGN PATENT DOCUMENTS 1078578 11/1954 France ..... 239/543

*Primary Examiner*—Robert B. Reeves
*Assistant Examiner*—Andres Kashnikow
*Attorney, Agent, or Firm*—B. P. Fishburne, Jr.

[57] ABSTRACT

To facilitate soldering pipe or tubing couplings in close quarters, as where a pipe rises close to a building wall, a hook-like flame tip is utilized having multiple spaced radial flame apertures on the interior side of its arcuate body portion to direct flame jets onto the rear side of the pipe coupling around one-half of its circumference. The distal end of the tubular flame tip is capped and its opposite end is adapted for connection to the torch in a conventional manner.

1 Claim, 5 Drawing Figures

FLAME TIP FOR SOLDERING TORCH

BACKGROUND OF THE INVENTION

A need exists for a ready and efficient means for soldering pipe couplings and the like where pipes extend close to building walls or other obstructions. Customarily, in such situations, haphazard and inconvenient means are resorted to for soldering around the rear side of the pipe, between the pipe and wall. The worker may place a sheet metal shield against the wall to prevent scorching it while attempting to solder around the rear of the pipe with a straight conventional flame tip. This is difficult and time consuming, and frequently a good solder joint is not produced at the rear of the pipe.

The object of the invention is to solve this problem completely by providing a hook-shaped flame tip or distributor capable of engaging around a pipe in close quarters between a pipe and wall and directing multiple radial jets of flame evenly around the rear side of the pipe for a full half of its circumference. The device is inexpensive, convenient to use, very efficient and can be coupled with conventional torch equipment.

DETAILED DESCRIPTION

Figure 1:
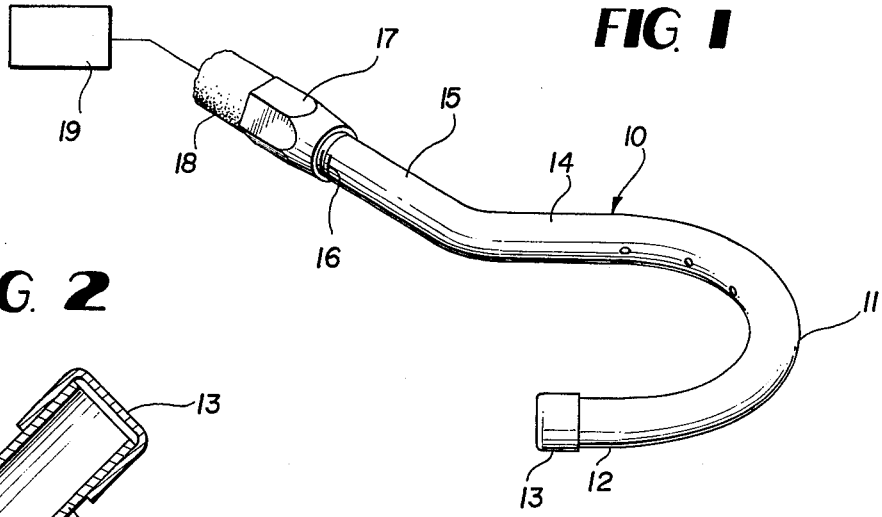
FIG. 1 is a perspective view of a flame tip or distributor for soldering according to the invention.
Figure 2:
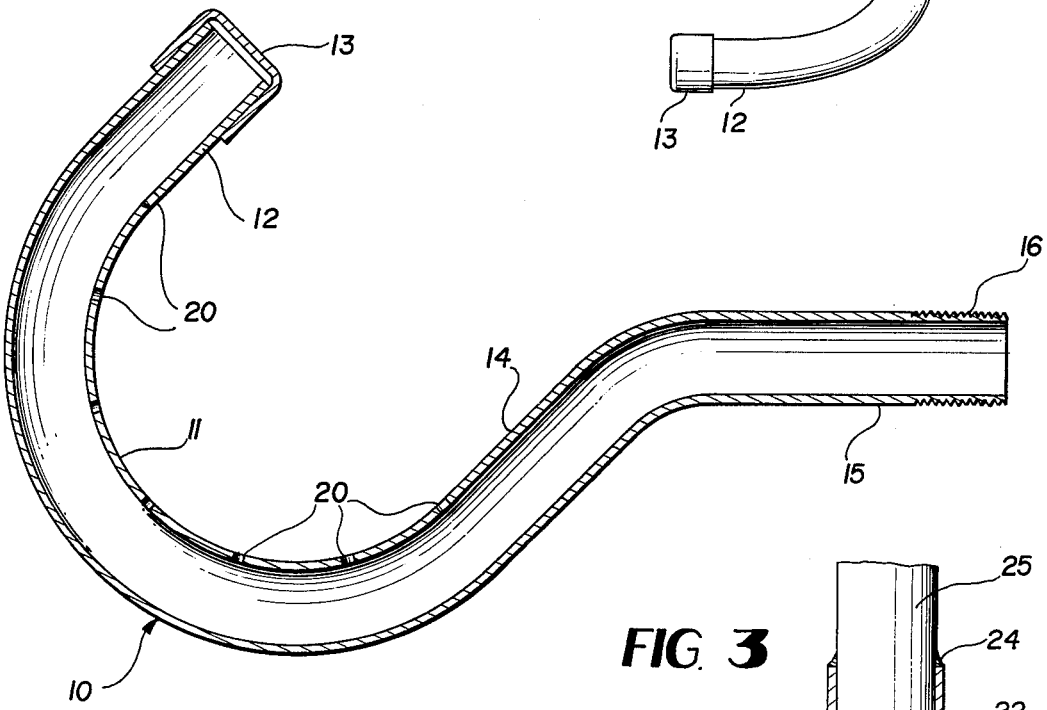
FIG. 2 is an enlarged central longitudinal section taken through the hook-like flame tip.

Referring to the drawings in detail, the invention comprises a hook-like flame tip 10 for soldering and the like including an arcuate body portion 11 extending for a full half-circle with a short straight section 12 on its distal end closed by a cap 13. In some cases, the distal end could be plugged or closed by pinching, if preferred. The opposite side of arcuate body portion 11 has a straight extension 14 parallel to the straight section 12 and joined with an angular rear terminal 15 which is threaded at 16 for engagement with a conventional coupling 17. The coupling 17 may connect the flame tip or distributor to a flexible hose 18 of suitable length leading to any conventional torch or burner device 19 shown schematically in FIG. 1. In some cases, the flexible hose 18 can be omitted and the coupling 17 connected directly with the outlet of a portable torch.

Figure 3:
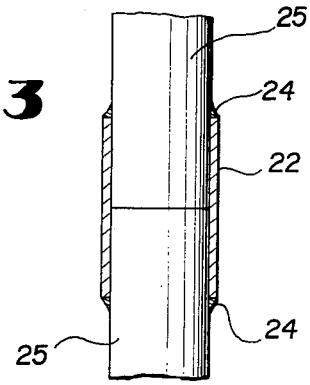
FIG. 3 is an elevational view, partly in section, showing a soldered pipe or tube coupling.
Figure 5:
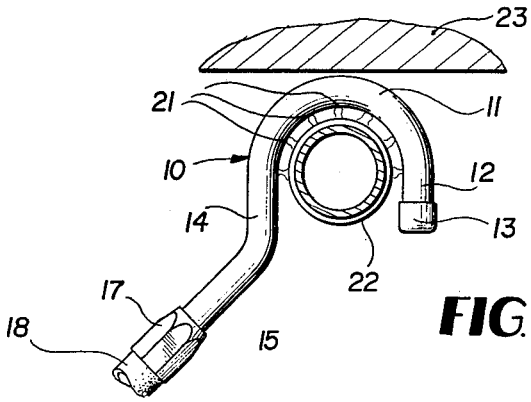
FIG. 5 is a similar view illustrating a soldering procedure by means of the invention.

On the interior side of the arcuate body portion 11, the same is provided with a plurality of equidistantly spaced small radial flame apertures 20 which, during use of the device, direct plural flame jets 21, FIG. 5, onto the rear side of a pipe coupling 22 close to a fixed wall 23 to produce solder joints 24, as illustrated in FIG. 3, for joining pipe sections 25 which may be copper tubes. As shown in FIG. 5, the hook-like tip or distributor is easily introduced into the narrow space between a rising pipe and wall to solder cleanly and evenly around the entire half circumference of the pipe facing the wall by means of the multiple flame jets. The device may be used in other close quarters.

Figure 4:
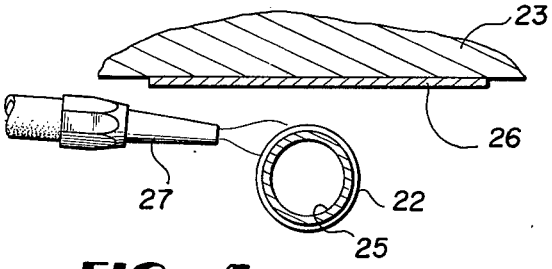
FIG. 4 PRIOR ART
FIG. 4 is a horizontal cross section taken through a pipe and adjacent wall and illustrating a prior art soldering procedure.

The invention eliminates the need for a metal or asbestos shield 26, FIG. 4, between a wall and pipe, as required in the customary prior art to protect the wall from scorching while attempting to solder the pipe coupling with a conventional straight flame tip 27 in an awkward operation. The advantages of the device will now be apparent to those skilled in the art.

Another advantages of the invention is that it eliminates the formation of "cold joints." Such joints occur when improper heating and/or solder placement produces unleaded sections in a joint which will leak when pressurized. Cold joints are difficult and costly to repair. With the invention, it is virtually impossible to produce a cold joint.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A flame tip for a soldering torch to facilitate soldering around a pipe in close quarters, comprising a single substantially rigid tube section which is externally threaded at one end for coupling to a flexible hose extending from a burner device, whereby the tube section can be easily and safely manipulated by hand to a variety of positions without being restrained in its movements, a closure cap for the end of the tube section remote from said threads and hose, the tube section including a comparatively short straight portion extending forwardly of said threads, an elbow at the forward end of the straight portion, a substantially semi-circular body portion extending forwardly from the elbow and having a center lying substantially on the axis of said straight portion, and another comparatively short straight portion leading from the semi-circular body portion and carrying said closure cap, said semi-circular body portion being provided in its interior side with a plurality of circumferentially equidistantly spaced radial flame jet apertures whose axes converge to the center of the semi-circular body portion.

* * * * *